US009941597B2

(12) United States Patent
Jonsson et al.

(10) Patent No.: US 9,941,597 B2
(45) Date of Patent: Apr. 10, 2018

(54) ANTENNA ARRANGEMENT

(71) Applicants: Stefan Jonsson, Stocksund (SE); Dan Karlsson, Solna (SE)

(72) Inventors: Stefan Jonsson, Stocksund (SE); Dan Karlsson, Solna (SE)

(73) Assignee: Cellmax Technologies AB, Kista (SE)

( * ) Notice: Subject to any disclaimer, the term of this patent is extended or adjusted under 35 U.S.C. 154(b) by 469 days.

(21) Appl. No.: 14/613,134

(22) Filed: Feb. 3, 2015

(65) Prior Publication Data

US 2015/0180135 A1 Jun. 25, 2015

Related U.S. Application Data

(63) Continuation of application No. 13/918,408, filed on Jun. 14, 2013, now Pat. No. 8,947,316, which is a (Continued)

(30) Foreign Application Priority Data

Sep. 24, 2007 (SE) ..... 0702121

(51) Int. Cl.
*H01Q 13/00* (2006.01)
*H01Q 21/00* (2006.01)
(Continued)

(52) U.S. Cl.
CPC ..... *H01Q 21/0006* (2013.01); *H01P 1/183* (2013.01); *H01Q 1/246* (2013.01);
(Continued)

(58) Field of Classification Search
CPC ..... H01Q 21/00; H01Q 9/16; H01Q 21/08; H01Q 1/24; H01Q 3/32; H01P 1/18
(Continued)

(56) References Cited

U.S. PATENT DOCUMENTS 2,760,193 A 8/1956 Riblet
3,617,953 A 11/1971 Kingma et al.
(Continued)

FOREIGN PATENT DOCUMENTS

GB 954097 A 4/1964
JP 6-204718A A 7/1994
(Continued)

OTHER PUBLICATIONS

Intent to Grant, European Patent Application 08834090.6-2220 070120EP dated Oct. 12, 2012, European Patent Office, 80298 Munich, Germany.
(Continued)

*Primary Examiner* — Jean B Jeanglaude
(74) *Attorney, Agent, or Firm* — The Jansson Firm; Pehr B. Jansson

(57) ABSTRACT

Antenna arrangement for a multi-radiator base station antenna, the antenna having a feeding network based on air filled coaxial lines (1, 2, 3), wherein each coaxial line comprises an outer conductor (8) and an inner conductor (4, 5, 6), wherein an adjustable differential phase shifter including a dielectric part (9) is arranged in the antenna and said dielectric part being movable longitudinally in relation to at least one coaxial line (1, 2, 3).

17 Claims, 9 Drawing Sheets

Related U.S. Application Data continuation of application No. 12/679,550, filed as application No. PCT/SE2008/051054 on Sep. 19, 2008, now Pat. No. 8,576,137.

(51) Int. Cl.

| | |
|---|---|
| ***H01P 1/18*** | (2006.01) |
| ***H01Q 1/24*** | (2006.01) |
| ***H01Q 3/32*** | (2006.01) |
| ***H01Q 21/08*** | (2006.01) |
| ***H01Q 9/16*** | (2006.01) |

(52) U.S. Cl.

CPC ..... *H01Q 3/32* (2013.01); *H01Q 9/16* (2013.01); *H01Q 21/08* (2013.01)

(58) Field of Classification Search

USPC ..... 343/778, 795, 797, 810–816, 850, 853, 343/835, 846, 860, 905

See application file for complete search history.

(56) References Cited

U.S. PATENT DOCUMENTS

| | | | | |
|---|---|---|---|---|
| 3,656,167 | A | 4/1972 | Lea | |
| 4,788,515 | A | 11/1988 | Wong et al. | |
| 5,086,304 | A | 2/1992 | Collins | |
| 5,339,058 | A | 8/1994 | Lique | |
| 5,543,000 | A | 8/1996 | Lique | |
| 5,801,600 | A | 9/1998 | Butland et al. | |
| 5,949,303 | A | 7/1999 | Arvidsson et al. | |
| 6,097,343 | A * | 8/2000 | Goetz | H01Q 1/286 343/708 |
| 6,118,353 | A | 9/2000 | McKay | |
| 6,222,499 | B1 * | 4/2001 | Goetz | H01Q 1/28 343/705 |
| 6,229,327 | B1 | 5/2001 | Boll et al. | |
| 6,333,683 | B1 | 12/2001 | Hampel | |
| 6,356,245 | B2 | 3/2002 | Metzen et al. | |
| 6,480,163 | B1 | 11/2002 | Knop et al. | |
| 6,563,399 | B2 | 5/2003 | Love | |
| 6,683,582 | B1 | 1/2004 | Love | |
| 6,756,948 | B2 | 6/2004 | Love | |
| 6,940,465 | B2 | 9/2005 | Gottl et al. | |
| 7,132,995 | B2 | 11/2006 | Gottl | |
| 2002/0135520 | A1 | 9/2002 | Teillet et al. | |

FOREIGN PATENT DOCUMENTS

| | | | |
|---|---|---|---|
| WO | WO98/09348 | A1 | 3/1998 |
| WO | WO0235651 | A1 | 5/2002 |
| WO | WO2005/101566 | A1 | 10/2005 |

OTHER PUBLICATIONS

Response to Communication pursuant to Rules 70(2) and 70a(2) EPC dated Oct. 21, 2011-Apr. 4, 2012, European Patent Application 08834090.6, dated Apr. 4, 2012, Stockholm, Sweden SE-10055.

European Search Report, European Patent Application 08834090.6 -2220, dated Apr. 10, 2011.

PCT/SE2008/051054 International Search Report, dated Jan. 12, 2009, Swedish Patent Office Box 5055, S-104 42 Stockholm.

Hideyuki, O, et al.: "Broadband Directional Coupler Using Dielectric Loaded Slit". Ieee mtt-s Digest, 1993, pp. 873-876.

PCT/SE2005/000548 International Search Report, dated Jul. 6, 2005, Swedish Patent Office Box 5055, S-102 42 Stockholm, Sweden.

CN1950973A Chinese Application No. 200580011198.2 text Portion of the Notification of the First Office Action.

PCT/SE2005/000548 Written Opinion of the International Searching Authority, dated Jul. 6, 2005, Swedish Patent Office Box 5055, S-102 42 Stockholm, Sweden.

* cited by examiner

ANTENNA ARRANGEMENT

BACKGROUND OF THE INVENTION

The present invention relates to an antenna arrangement for a multi-radiator base station antenna, the antenna having a feeding network based on air filled coaxial lines, wherein the coaxial lines preferably are an integrated part of the antenna reflector. The invention especially relates to such an antenna having a variable electrical elevation tilt angle. Electrical elevation tilt angle is henceforth termed tilt angle.

Antennas in telecommunication systems such as cellular networks today typically use multi-radiator structures. Such antennas make use of an internal feeding network that distributes the signal from a common coaxial connector to the radiators when the antenna is transmitting and in the opposite direction when the antenna is receiving. Typically the radiators are positioned in a vertical column. This arrangement reduces the elevation beam width of the antenna and by that increases the antenna gain. The antenna tilt angle is determined by the relative phases of the signals feeding the radiators. The relative phases can be fixed giving the antenna a predetermined tilt angle, or the relative phases can be variable if a variable tilt angle is required. In the latter case, the tilt angle can be adjusted manually or remotely.

Base station antennas with variable tilt angles using adjustable phase shifters already exist and are widely deployed, but their performance has so far been limited by the loss introduced in the internal feeding network and in the phase shifters. The feeding network is typically realized using coaxial cables having small dimensions in order to be bendable by hand in a small radius and favourable in price. Such cables introduce significant loss. The phase shifter is commonly realized in microstrip or stripline technology, known from WO 02/35651 A1, now U.S. Pat. No. 6,906,666. Phase shifting might be obtained by moving a dielectric part within this structure. The conductors typically have rather small dimensions and because of this they will introduce resistive losses. Typically such feeding networks, together with the phase shifter, introduce 1-3 dB loss. This will result in 1-3 dB lower antenna gain.

Improved antenna gain results in increased range, higher capacity and better quality of service for a base station, and will result in considerable savings and higher revenues for the operator.

The object of the present invention is therefore to provide a novel antenna with a variable tilt angle having a higher antenna gain than prior art antennas with variable tilt angle.

This object is obtained with an antenna having an adjustable differential phase shifter including a dielectric part that is arranged in the antenna and is movable longitudinally in relation to at least one coaxial line.

SUMMARY OF THE INVENTION

The present invention relates to an antenna that uses novel types of adjustable differential phase shifters that can easily be integrated into an antenna with a low loss feeding network as described in applicant's earlier application WO 2005/101566 A1, now U.S. Pat. No. 7,619,580. A typical feeding network for a fixed tilt antenna as described in this prior application is shown in FIG. 1. The antenna feeding network uses a number of splitters/combiners (reciprocal networks) that split/combine the signal in two or more. In order to simplify the text, only the splitting (transmitting) function is described, but the splitter/combiner is fully reciprocal which means that the same type of reasoning can be applied to the combining (receiving) function. By replacing some of the splitters/combiners in the fixed tilt antenna by differential phase shifters, an antenna with variable tilt angle can be made. Two embodiments of such variable tilt antennas are shown in FIG. 2 and FIG. 3, but other embodiments are also possible.

The differential phase shifter is a device that comprises a splitter with one input and two or more outputs. The differential phase of the signals coming from the splitter will vary depending on the setting of the phase shifter.

The phase shift is achieved by moving a dielectric part that is located between the inner conductor and the outer conductor of the coaxial lines. It is a known physical property that introducing a material with higher permittivity than air in a transmission line will reduce the phase velocity of a wave propagating along that transmission line. This can also be perceived as delaying the signal or introducing a phase lag compared to a coaxial line that has no dielectric material between the inner and outer conductors.

Adjustable phase shifters using the principle of introducing a dielectric material in a coaxial line have also been described in e.g. U.S. Pat. No. 4,788,515, but this document describes a phase shifter where the dielectric parts are more or less introduced into the coaxial line in order to vary the absolute phase shift through the device, whereas the present invention describes a differential phase shifter where the dielectric part is moved inside the coaxial line in order to vary the relative phase or phases coming from the two or more outputs.

BRIEF DESCRIPTION OF THE DRAWINGS

The invention will now be described in more detail in connection with a couple of non-limiting embodiments of the invention shown on the appended drawings, in which.

DETAILED DESCRIPTION

Figure 1:
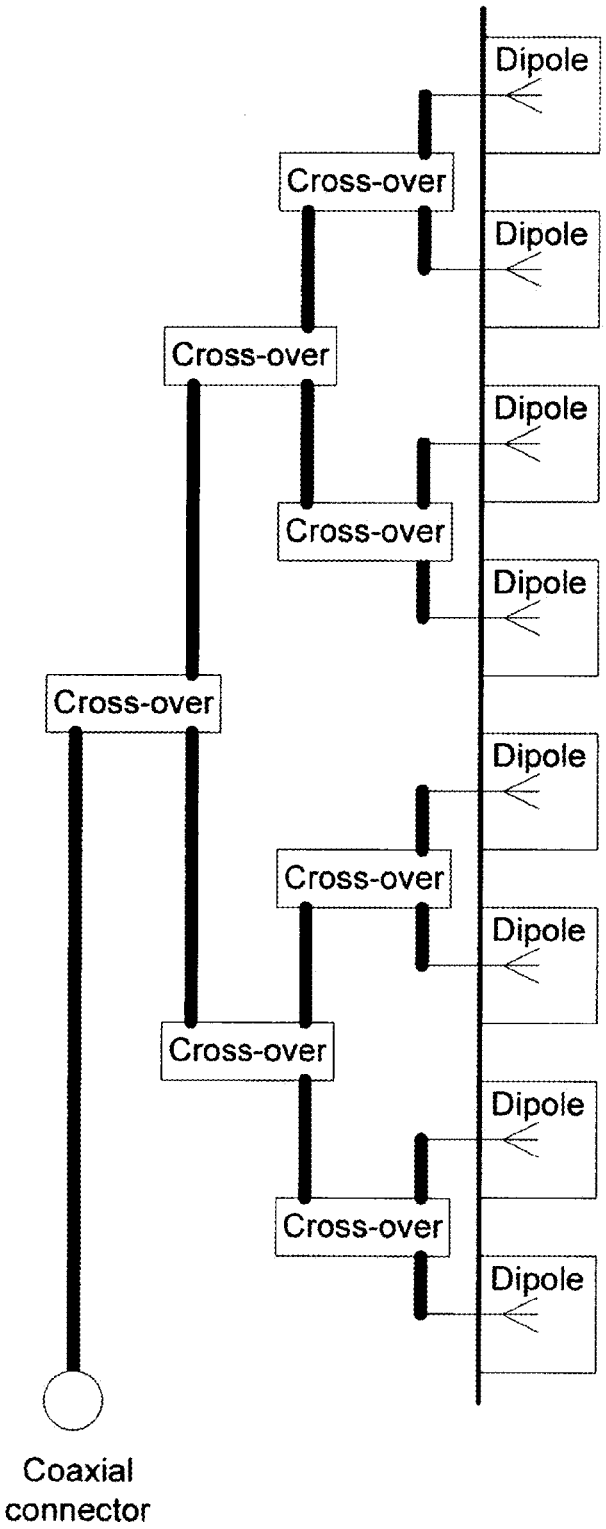
FIG. 1 shows an example of a common feeding network for a fixed tilt antenna according to prior art.
Figure 2:
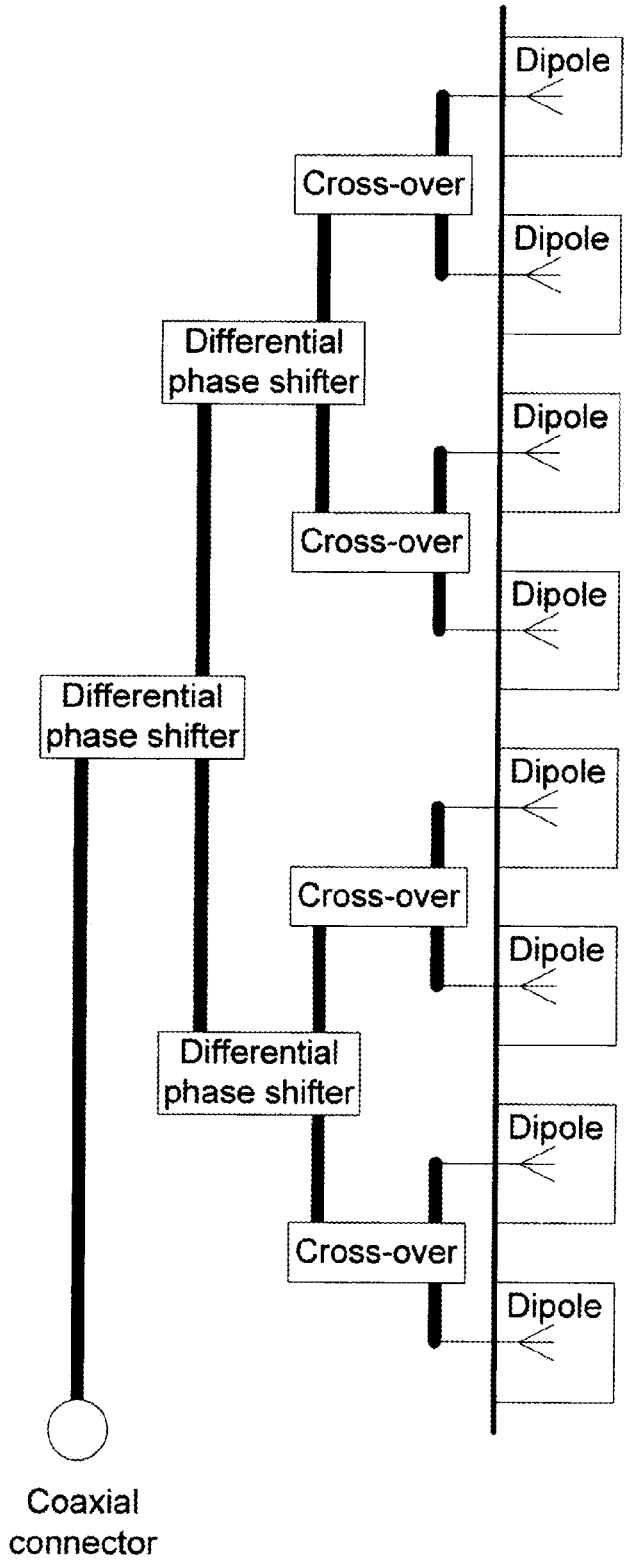
FIG. 2 shows a feeding network for an antenna with a variable tilt angle, embodying differential phase shifters.
Figure 3:
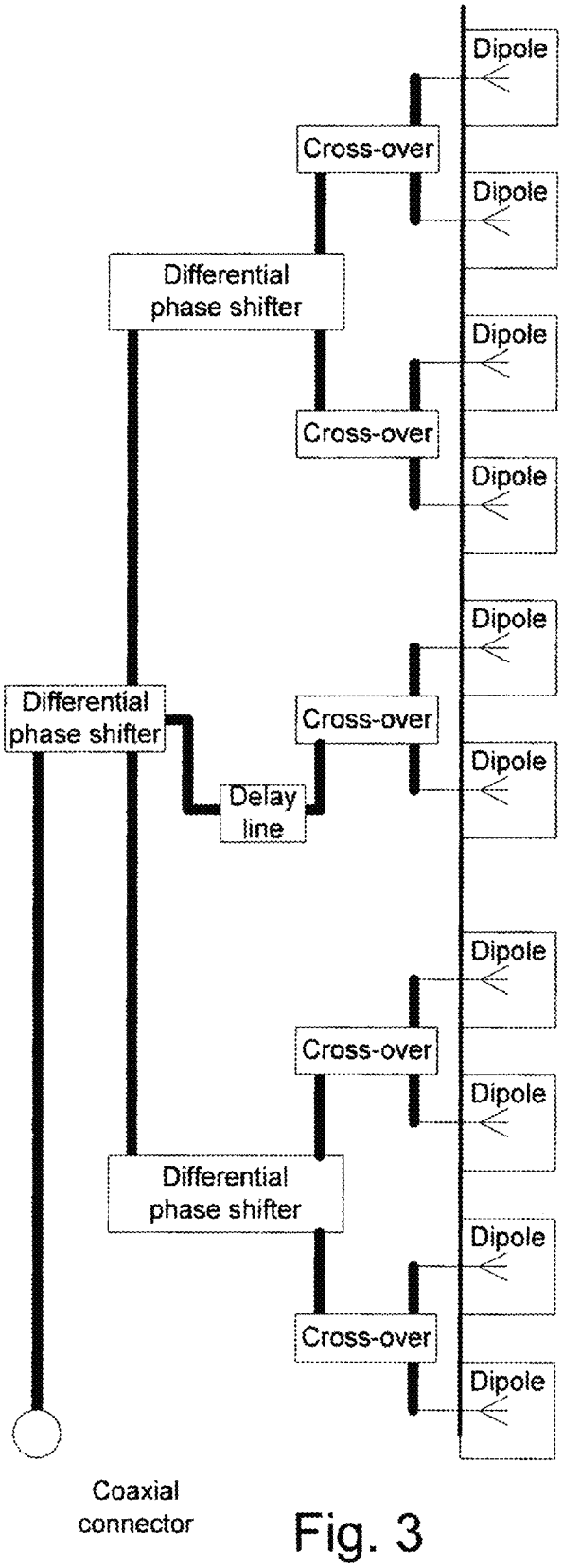
FIG. 3 shows a feeding network for another antenna with a variable tilt angle, embodying differential phase shifters together with a delay line.
Figure 4:
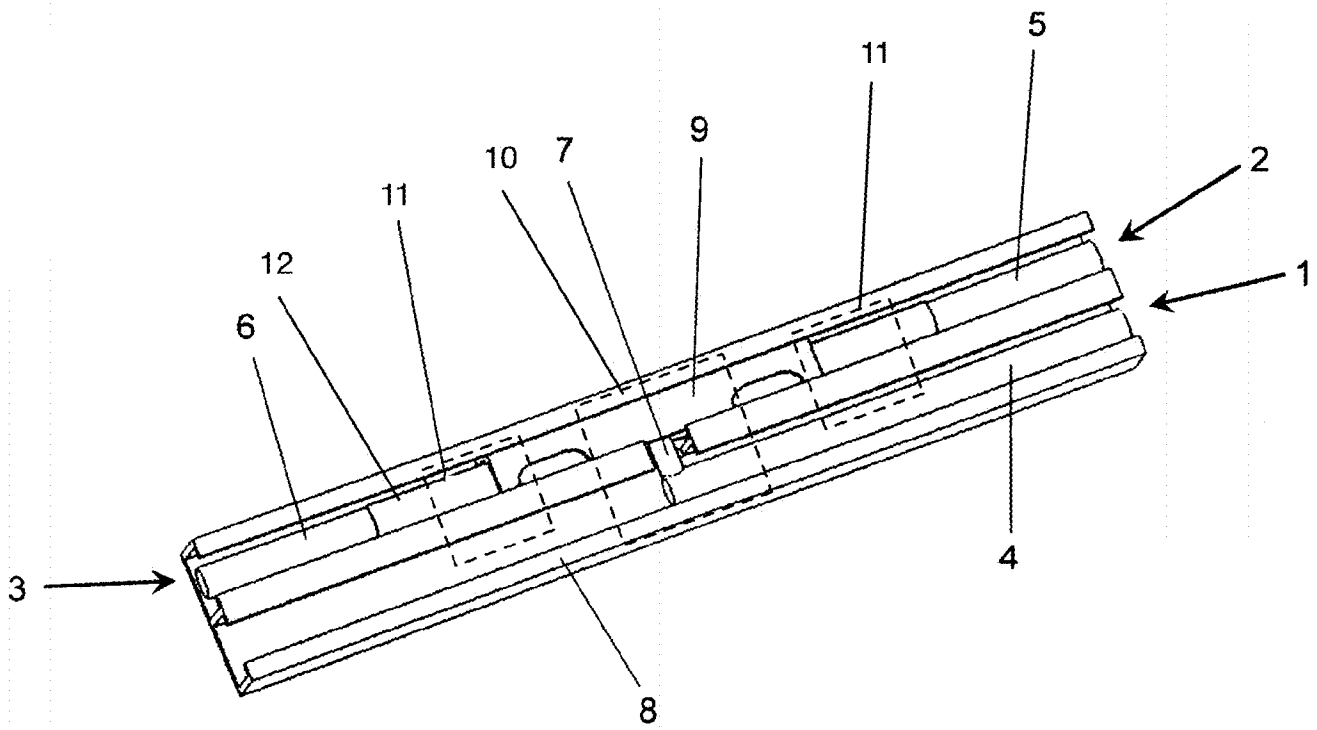
FIG. 4 shows a first preferred embodiment of a differential phase shifter according to the present invention.

One embodiment of a differential phase shifter according to the present invention is shown in FIG. 4. The differential phase shifter comprises one input coaxial line 1, a first output coaxial line 2 and a second output coaxial line 3, both output coaxial lines having the same length in this example. An extruded metal profile 8 is used as outer conductor for all coaxial lines, in the same way as described in WO 2005/101566 A1, now U.S. Pat. No. 7,619,580. The input coaxial line inner conductor 4 is connected to the first output coaxial line inner conductor 5 and the second output inner conductor 6 via a crossover 7 covered by a conductive lid 10. This differential phase shifter can typically be used in an antenna having e.g. 4, 8 or 16 radiators, one example being shown in FIG. 2. The differential phase shifter in FIG. 4 can also be used in other configurations, e.g. as shown in FIG. 3.

A dielectric part 9 partly fills the space between the inner and outer conductors of the first and second output coaxial lines. The dielectric part has a permittivity that is higher than that of air.

The dielectric part can be moved along the first and second coaxial output lines 2 and 3, and thus has various positions along those coaxial lines. We first consider the case when the dielectric part 9 is placed in a central position, equally filling the first and second output coaxial lines. When a signal is entered at the input coaxial line 1, it will be divided between the first output coaxial line 2 and the second output coaxial line 3, and the signals coming from the two output coaxial lines will be equal in phase.

If the dielectric part 9 is moved in such a way that the first output coaxial line 2 will be more filled with dielectric material than the second output coaxial line 3, the phase shift from the input to the first output will increase. At the same time the second output coaxial line 3 will be less filled with dielectric, and the phase shift from the input to the second output will decrease. Hence, the phase at the first output will lag the phase at the second output.

If the dielectric part is moved in the opposite direction, the phase of the first output will lead the phase of the second output.

Figure 5:
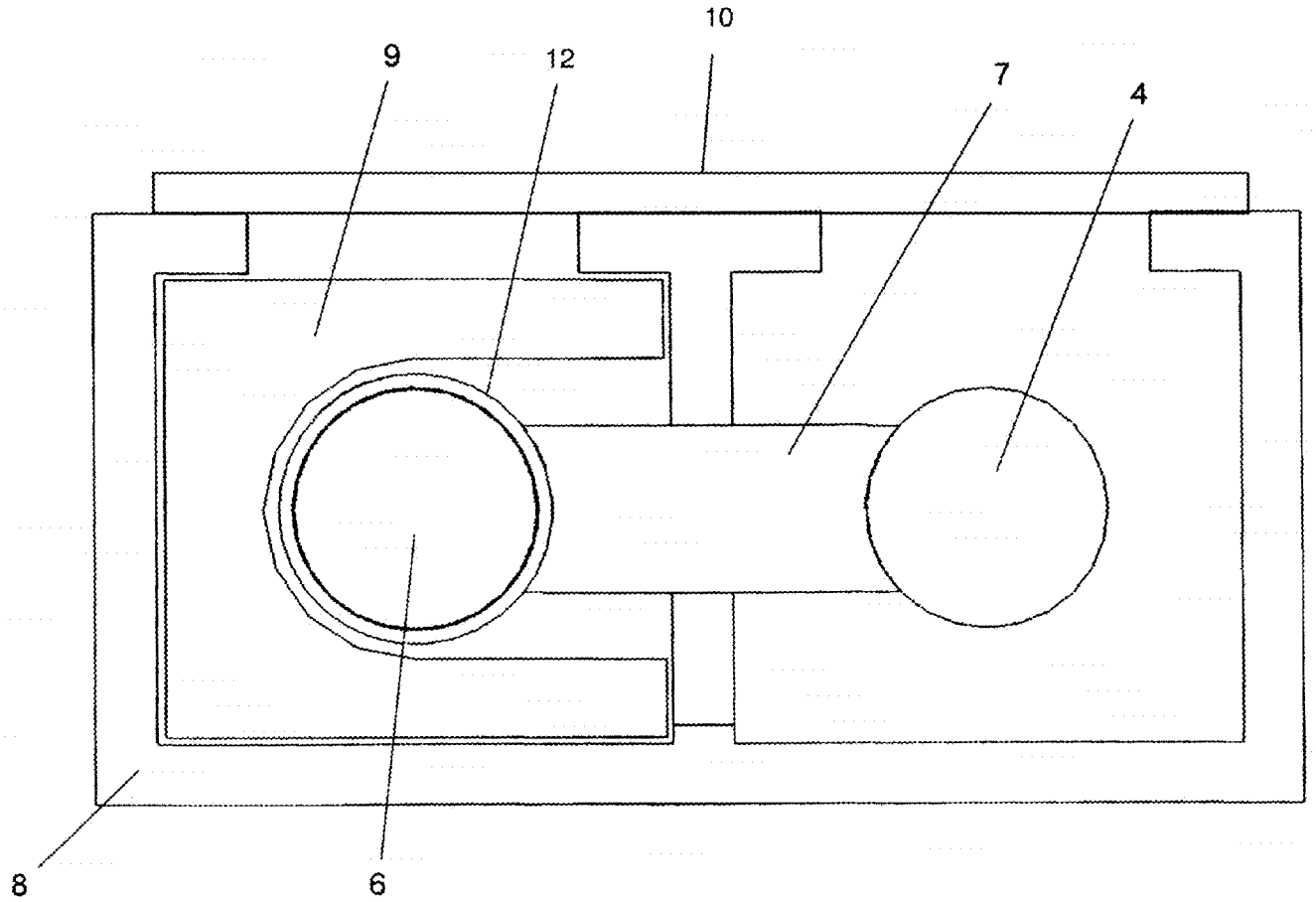
FIG. 5 shows a cross section view of the differential phase shifter in FIG. 4.

FIG. 5 shows a cross-section of the two-way differential phase shifter. It can be seen that the dielectric part 9 partly fills out the space between the inner conductor 6 and the outer conductor 8. Because of the cross-over 7, the dielectric part 9 cannot fully surround the inner conductor 6 and therefore it must have an opening on one side. This C-shaped cross-section will give the best filling of the coaxial line, and hence the differential phase shifter will introduce the maximal phase shift for a given movement of the dielectric part. The position of the dielectric part relative to the outer and inner conductors affects the phase shift and the line impedance, and during its movement, it is preferably guided by the walls formed by the outer conductor. The dielectric part can preferably be made in a polymer material that is filled with a ceramic powder having a high permittivity, but other materials could also be used.

Figure 7:
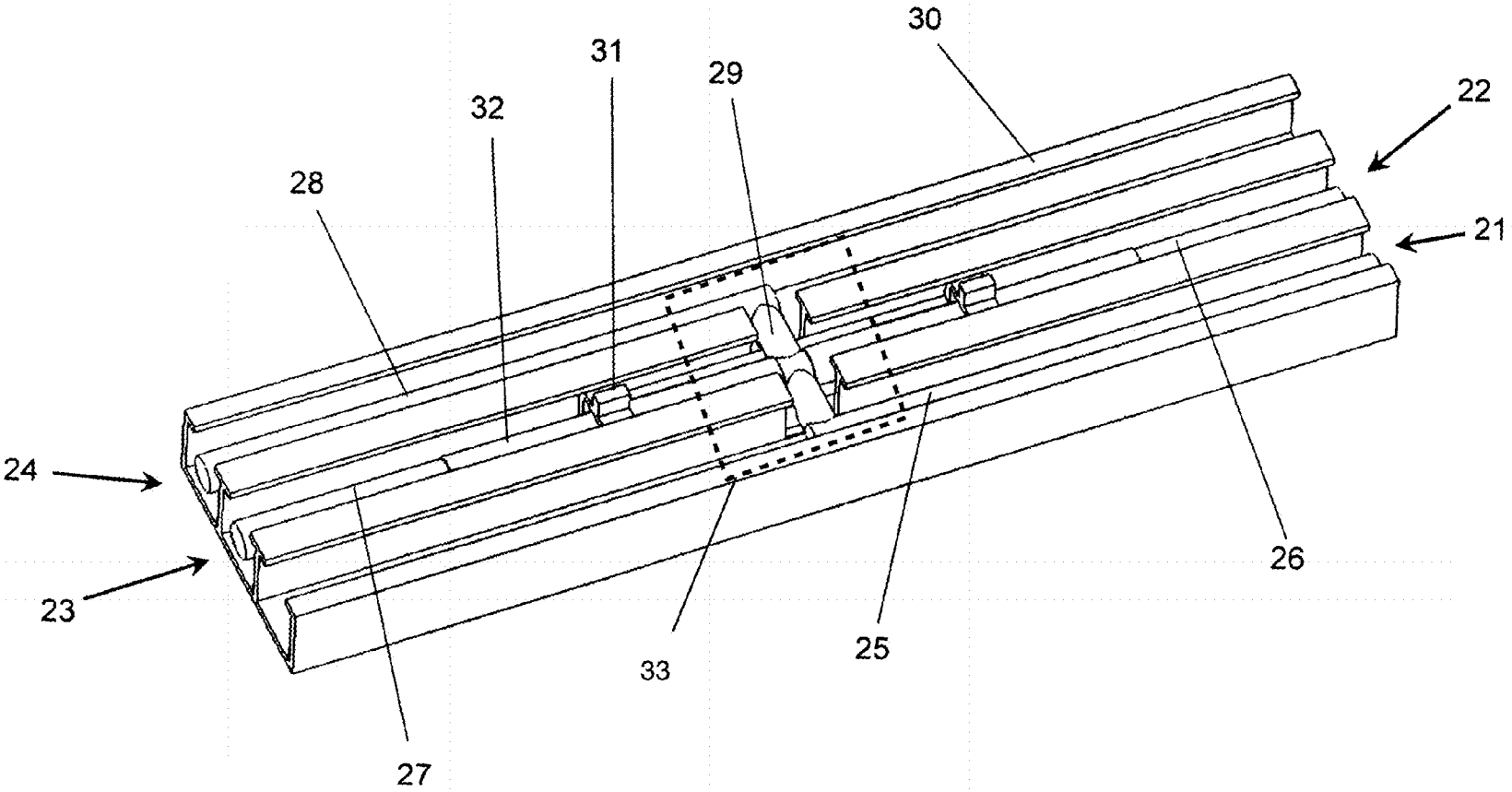
FIG. 7 shows a second preferred embodiment of a differential phase shifter according to the invention.

In another embodiment, the differential phase shifter has one input and three outputs. Such a three-way differential phase shifter is shown in FIG. 7. In this embodiment, the phase shifter comprises one input coaxial line 21, three output coaxial lines 22, 23 and 24, a cross over 29, a conductive lid 33 and the dielectric part 31. It can be noted that the signal at the output of the coaxial line 24 will always have the same phase shift regardless of the position of the dielectric part, and the relative phase of the two other outputs 22 and 23 will vary according to the same principles as described for the two-way differential phase shifter above. Correspondingly the coaxial lines each comprise an inner conductor 25, 26, 27 and 28, respectively, as well as an outer conductor 30 preferably being an integrated part of the antenna reflector. This differential phase shifter can be used in an antenna having e.g. 3, 5, 6, 10, 15 or 20 radiators, but other configurations could also be used.

Figure 9:
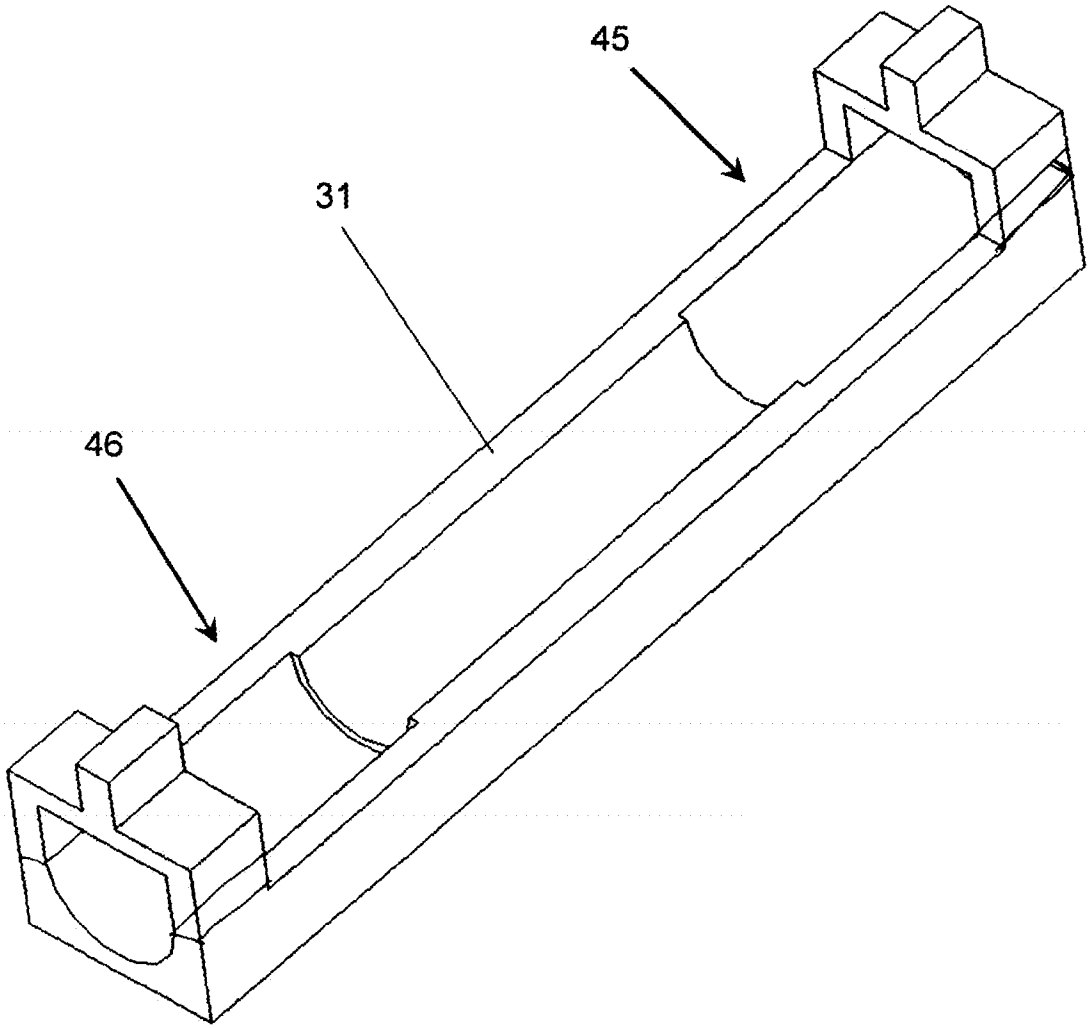
FIG. 9 shows an embodiment of a dielectric part of the differential phase shifter in FIGS. 7 and 8.

FIG. 9 shows another embodiment of the dielectric part 31 that can be used for the three-way differential phase shifter. Because of the shape of the crossover 29, the cross-section of the dielectric part 31 is U-shaped. The use of this embodiment of the dielectric part is not limited to the three-way differential phase shifter. Other embodiments of the dielectric part are also possible.

A splitter/combiner as described above is typically used in a 50 ohm system. If the two output coaxial lines 2 and 3 were 50 ohm lines, the input coaxial line would see 25 ohm at the junction point with the two output coaxial lines. This will give an impedance mismatch. In order to maintain 50 ohm at the input it is necessary to introduce impedance transformation in the output coaxial lines, in the input coaxial line, in the crossover, or in a combination of those. This impedance matching is typically achieved by varying the diameter of segments along the inner conductors, and/or by varying the dimensions of the crossover, or its position relative to the outer conductor. If the impedance transformation is the same in both output coaxial lines, power will be split equally between the two outputs and if the impedance transformation is not the same in the two output coaxial lines, power will be unequally split. Unequal power split can be used for shaping the radiation pattern of the antenna.

Figure 6:
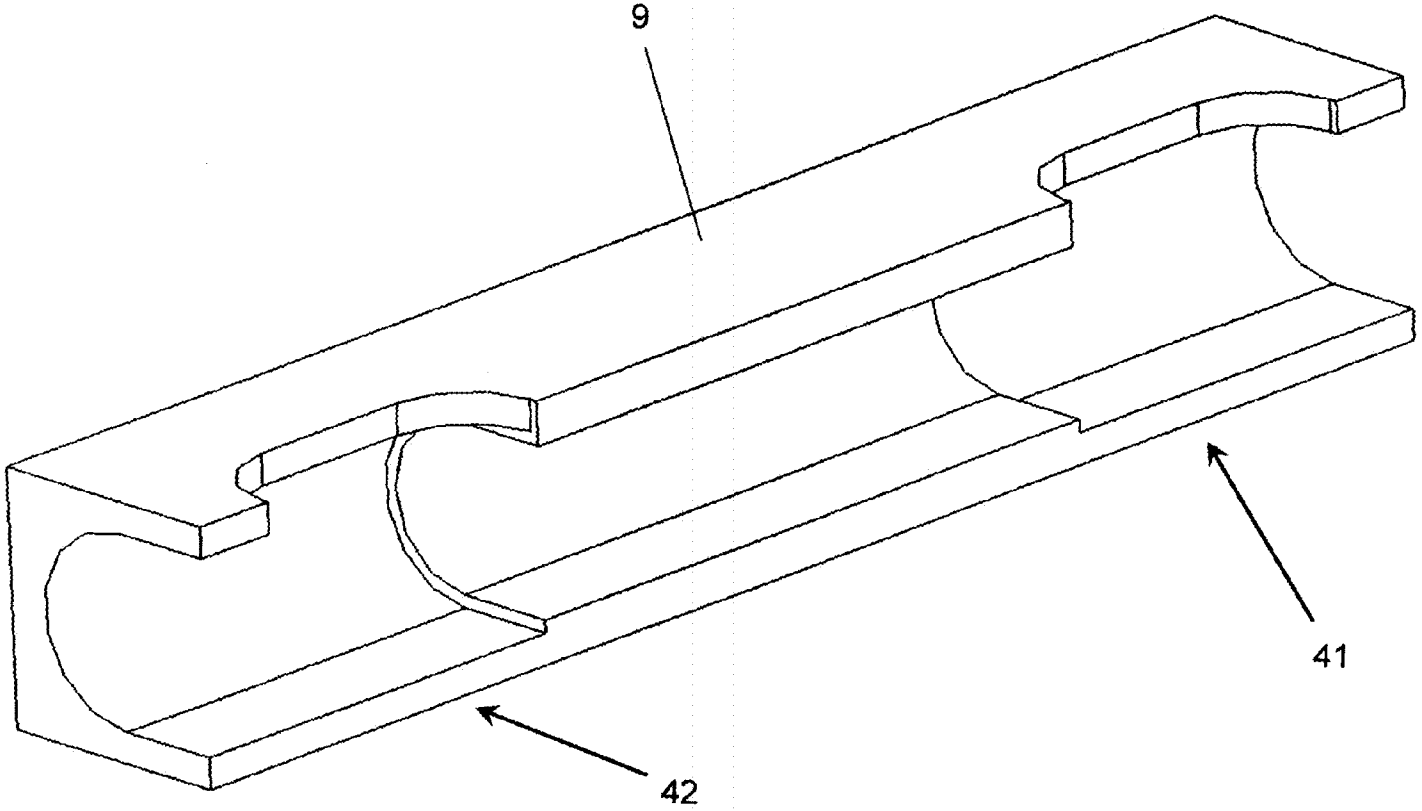
FIG. 6 shows an embodiment of a dielectric part of the differential phase shifter in FIGS. 4 and 5.

Introducing the dielectric part within the output coaxial lines will not only create a phase shift, it will also lower the characteristic impedance of the output coaxial lines. It is therefore necessary to add impedance transformation sections at the interfaces between the portions of the output coaxial lines that are filled with the dielectric part, and the portions that are not filled. As the dielectric part is moving along the output coaxial lines, it is not possible to make a fixed matching by adjusting the diameter of segments of the output coaxial lines as described above. Instead, the impedance transformation is achieved by reducing the amount of dielectric material in the end segments of the dielectric part. The length of those segments is typically one quarter of a wavelength. A first embodiment of the dielectric part is shown in FIG. 6, with two impedance matching sections 41 and 42, and a second embodiment of the U-shaped dielectric part is shown in FIG. 9, with impedance matching sections 45 and 46. The impedance matching of the differential phase shifter must take into account the lower impedances of the output coaxial lines caused be the presence of the dielectric part.

As noted above, in order to obtain the most phase shift for a given movement of the dielectric part, it is necessary to fill out the space between the inner conductor and the outer conductor with as much dielectric material as possible and also to use a material with a high permittivity, like the ceramic filled material proposed above. Ceramic filling may cause significant friction between the dielectric part and the inner and outer conductors. In order to reduce friction, a significant space is necessary between the inner conductor and the dielectric part because of dimensional- and geometrical tolerances. By placing a polymer layer 12 or 32 of some smooth material such as PTFE around the inner conductor, it will be possible to let the dielectric part touch this layer. This layer can typically be a PTFE tube, but other realisations could also be used. This polymer layer need not completely surround the inner conductor. If the layer is made in a material that has a higher permittivity than air, such as PTFE, this will also enhance the phase shift for a given movement of the dielectric part even though the polymer layer has a fixed position along the coaxial line.

Antennas with variable tilt angle are designed to be able to vary the tilt angle within a specified range, e.g. 0 to 10 degrees. If the required tilt range is between x degrees and y degrees, the basic feeding network, with the phase shifters set in their central position, will be designed to give a tilt angle of $(x+y)/2$ degrees (middle tilt angle). The phase shifters will then allow the tilt to be varied above and below that middle tilt angle.

When using the three-way differential phase shifter shown in FIG. 7, the output coaxial line 24 will have significantly less delay than the two other output coaxial lines 22, 23. It is therefore necessary to introduce extra phase shift by means of a delay line shown in FIG. 3. Such a delay line can be realized within the open coaxial line structure that is described in WO 2005/101566 A1, e.g. by varying the diameter of the inner conductor.

As described in WO 2005/101566 A1, now U.S. Pat. No. 7,619,580, in order to reduce radiation losses, it can be advantageous to use a conductive lid 10, 33 over the junction between the input coaxial line and the two output coaxial lines. This is also the case with the differential phase shifters in FIGS. 4 and 7. The conductive lids are shown by dashed lines in FIGS. 4 and 7 for the sake of visibility.

In addition to this, a new problem can occur when introducing the dielectric parts in the coaxial lines. When a dielectric is introduced, the wavelength of a wave propagating along the coaxial line will become shorter. As a result, at higher frequencies, the wavelength can approach the dimensions of the cross-section of the coaxial line. This may cause other modes than the normal TEM mode to propagate. This can result in radiation losses from the slit in the output coaxial lines. One important parameter when specifying an antenna is the front-to-back ratio that typically should be kept as high as possible. If the output coaxial lines radiate, this ratio can be compromised. By introducing conductive lids 11, shown in FIG. 4, over the portion of the output coaxial lines where the dielectric part 9 may be located, this radiation effect can be prevented, or at least reduced. The lids 11 can be galvanically connected to the outer conductors 8 of the output coaxial lines or capacitively connected to said outer conductors by means of a thin isolating layer. Because of constraints due to the mechanical design, it may be impossible to cover the whole length of the output coaxial lines where the dielectric part may be located. Using the lids 11, covering only a portion of the length where the dielectric part 9 may be located, is in most cases sufficient to reduce radiation and fulfil the requirements on front-to-back ratio, and to keep radiation losses negligible.

Another solution could be to use output coaxial lines without slits. Machining will then be needed to open up the output coaxial lines to access the dielectric part 9.

Figure 8:
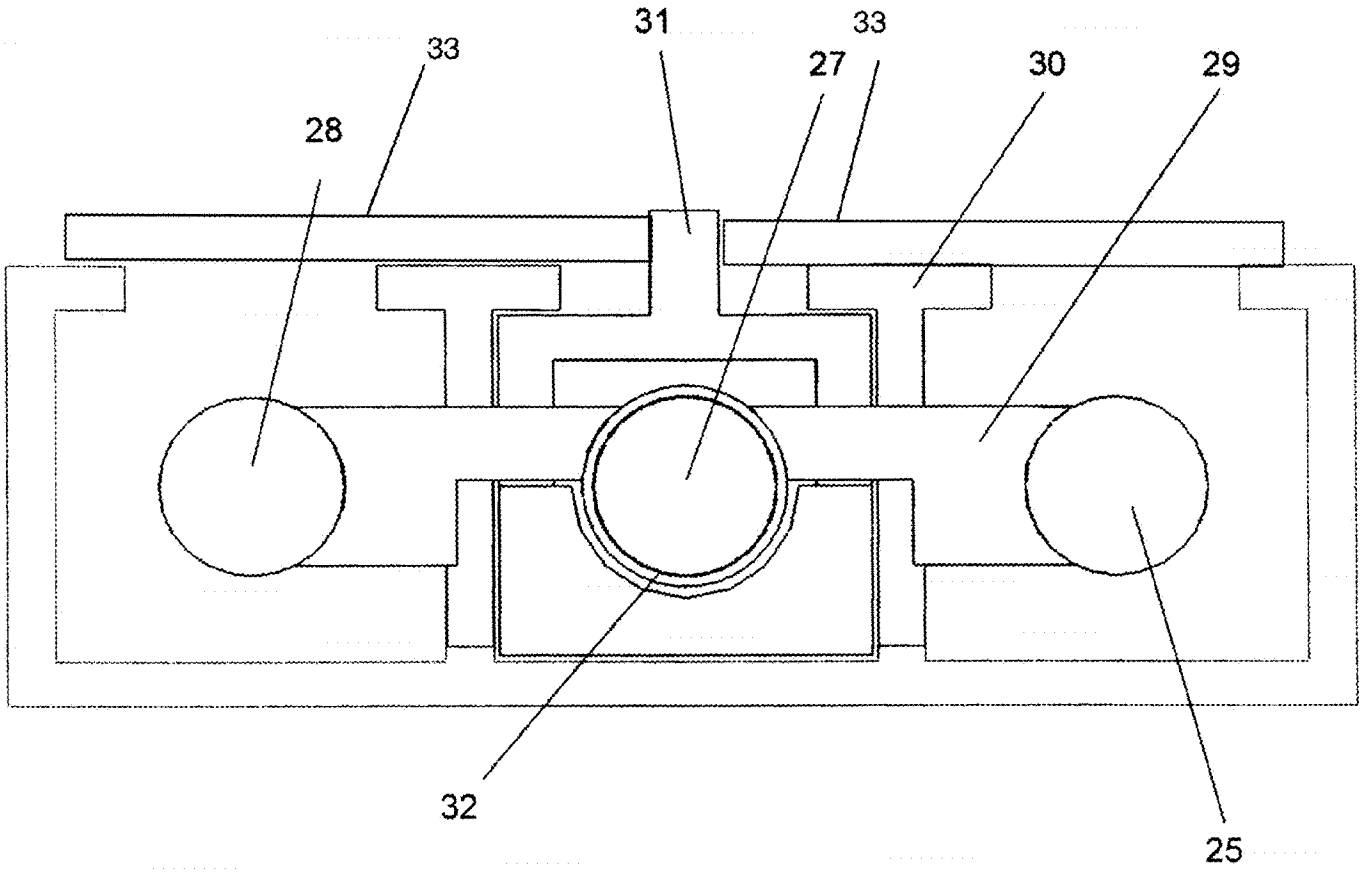
FIG. 8 shows a cross section view of the differential phase shifter in FIG. 7.

If the dielectric part is symmetric around a plane through the centre of the inner conductor and said plane being perpendicular to the antenna reflector as shown in FIG. 8, only the TEM mode will propagate, and the radiation losses due to the lack of symmetry mentioned above will be eliminated. The lid 33 over the crossover will anyway still be needed.

So far, this application has discussed a single polarisation antenna comprising one feeding network, but the same ideas could be used for a dual polarisation antenna. In such an embodiment, the antenna would comprise two feeding networks, one feeding network for each of the two polarisations.

The invention claimed is:

1. A multi-radiator base station antenna, comprising: a feeding network having coaxial lines, wherein each coaxial line comprises an outer conductor and an inner conductor; and an adjustable differential phase shifter including a dielectric part arranged in the antenna and said dielectric part being movable longitudinally in relation to at least one coaxial line where said at least one coaxial line has an impedance matching section such as to shape the radiation pattern of the base station antenna.

2. The antenna according to claim 1, wherein the antenna further comprises at least one set of one input and two output coaxial lines where the two output coaxial lines are aligned but pointing in opposite directions and the input coaxial line is connected to one end of each of the two output coaxial lines, wherein one differential phase shifter is arranged for at least one set of output coaxial lines so that by moving the dielectric part that is present within the two output coaxial lines the phase at the outputs is varied, and where the impedance matching in output coaxial lines are made in such a way that the power at the two outputs is different from each other.

3. The antenna according to claim 2, wherein the dielectric part (9) in cross section is at least partially open on at least one side.

4. The antenna according to claim 2, wherein the dielectric part is guided by the outer conductor.

5. The antenna according to claim claim 2, wherein the dielectric part is guided by the inner conductor.

6. The antenna according to claim 2, wherein the diameter of the inner conductors is varied and chosen such as to form impedance matching networks.

7. The antenna according to claim 2, wherein the dielectric part have impedance matching sections.

8. The Antenna according to claim 2 where the dielectric part is essentially surrounded by the outer conductor.

9. The antenna according to claim 1, wherein the antenna further comprises at least one set of one input and three output coaxial lines where two output coaxial lines are aligned but pointing in opposite directions, and the input coaxial line is connected to one end of each of the three output coaxial lines, wherein one differential phase shifter is arranged for at least one set of aligned output coaxial lines so that by moving the dielectric part that is present within the two aligned output coaxial lines the phase at the two outputs is varied and where the impedance matching in output coaxial lines are made in such a way that the power at the two outputs is different from each other.

10. The antenna according to claim 9, wherein the dielectric part have impedance matching sections.

11. The Antenna according to claim 9 where the dielectric part is essentially surrounded by the outer conductor.

12. The antenna according to claim 9, wherein the dielectric part in cross section is at least partially open on at least one side.

13. The antenna according to claim 9, wherein the dielectric part (9) is guided by the outer conductor.

14. The antenna according to claim 9, wherein the dielectric part is guided by the inner conductor.

15. The antenna according to claim 9, wherein the diameter of the inner conductors is varied and chosen such as to form impedance matching networks.

16. The antenna according to claim 1, wherein the antenna comprises dual polarised radiators.

17. The antenna according to claim 1, wherein the coaxial lines and the adjustable differential phase shifter are integrated parts of an antenna reflector.

* * * * *